US005685653A

United States Patent [19]

Bringhurst

[11] Patent Number: 5,685,653

[45] Date of Patent: Nov. 11, 1997

[54] METHOD AND SYSTEM FOR CONTROLLED INKING OF PRINTER RIBBONS

[75] Inventor: Edward D. Bringhurst, Federal Way, Wash.

[73] Assignee: Mannesmann Tally Corporation, Kent, Wash.

[21] Appl. No.: 771,378

[22] Filed: Dec. 16, 1996

Related U.S. Application Data

[63] Continuation of Ser. No. 547,506, Oct. 24, 1995, abandoned.

[51] Int. Cl.[6] ..... B41J 27/12

[52] U.S. Cl. ..... 400/197; 400/225; 400/232

[58] Field of Search ..... 400/197, 200, 400/202, 202.1, 202.2, 202.4, 225, 229, 232

[56] References Cited

U.S. PATENT DOCUMENTS

| | | | |
|---|---|---|---|
| 4,440,514 | 4/1984 | Keiter et al. . | |
| 4,619,537 | 10/1986 | Do et al. . | |
| 4,632,582 | 12/1986 | Houston . | |
| 4,728,206 | 3/1988 | Mori et al. . | |
| 4,969,761 | 11/1990 | Gibson-Saxty . | |
| 4,984,913 | 1/1991 | Silverman et al. . | |
| 5,035,522 | 7/1991 | Wright | 400/197 |
| 5,087,137 | 2/1992 | Burnard et al. . | |
| 5,108,209 | 4/1992 | Menzenski . | |
| 5,162,815 | 11/1992 | Hodge . | |
| 5,318,369 | 6/1994 | Ishii . | |

FOREIGN PATENT DOCUMENTS

| | | | |
|---|---|---|---|
| 132580 | 8/1983 | Japan | 400/200 |

*Primary Examiner*—Ren Yan

*Attorney, Agent, or Firm*—Christensen, O'Connor, Johnson & Kindness PLLC

[57] ABSTRACT

A method and apparatus for extending the useful life of a printing ribbon by controlling the ratio of ink used to ink applied to the ribbon, while maintaining visual clarity of printed characters. A counter accumulates the number of characters printed, and the print density, over a preset period of time. The number of characters printed is compared with predetermined triggering numbers of characters, and the print density is likewise compared with a predetermined triggering print density. As a result of this comparison, the speed of the printer ribbon is increased to allow an increase in the ratio of ink applied to ink used, when the number of characters and print density are high. Conversely, ribbon speed is decreased when the number of characters printed during the preset time period, and the print density, are low, to prevent overinking and fouling of printer hammers. This condition applies when the ribbon is relatively new.

26 Claims, 3 Drawing Sheets

METHOD AND SYSTEM FOR CONTROLLED INKING OF PRINTER RIBBONS

This application is a continuation application of application Ser. No. 08/547,506, filed on Oct. 24, 1995, now abandoned.

FIELD OF THE INVENTION

The invention provides a method and apparatus for controlling the rate of inking of a ribbon used in a printer thereby extending the useful life of the ribbon by reducing the tendency of the printer to produce printed characters of progressively fading visual clarity. More specifically, the invention monitors the number of characters printed and adjusts the rate of ribbon reinking to ensure the production of sharply defined printed characters and to prevent excessive ink buildup.

BACKGROUND OF THE INVENTION

Of the variety of commercially available printers, many require the use of a printing ribbon, generally a strip of organic polymeric material, such as woven nylon, that may be coated or impregnated with an ink. This ribbon is interposed between printing hammers and paper so that impact of the hammers on the ribbon transfers ink to the paper. An exemplary ribbon cassette assembly 10 includes a flat, substantially rectangular housing 15, as shown in FIG. 1. A substantially rectangular outlet ribbon guide 16 extends perpendicularly outward from one end of the housing. Ribbon 14 is fed out through the guide and exposed ribbon is then turned at right angles to advance in a direction parallel to an adjacent long side of the rectangular housing to an inlet ribbon guide 18, extending outward from an opposite end of the housing 15. In some instances, such as in the illustrated example, a substantially flat removable cover 17 is located on an upper flat side of the rectangular housing 15. This removable cover covers an internal space 12 for housing mechanical drive components of the cassette ribbon. Cylindrical knob 20 is part of the upper end of an axis 32 of an internal ribbon drive roller 31 that extends through a hole in the cover 17.

In normal operation, the cassette is installed into a printer so that a bank of print hammers (not shown) is located in the space H between the exposed ribbon 14 and the housing 15. The cassette is located in place in the printer by the drive shaft of a stepping motor and other guides, not shown, to position the ribbon in the printer. Typically, dot matrix print hammers have 1/32 inch diameter balls or 0.008 to 0.016 diameter pins mounted on their tips as print elements. During printing, these print elements impact the ribbon causing contact between ribbon and paper so that ink is transferred to the paper in the form of a dot resembling the print element, i.e., printing takes place. The ribbon continuously travels in a direction transverse to the direction of paper travel across the print surfaces of the print hammers into ribbon guide 18, around a cylindrical rotating surface of an ink transfer roller 38. The reinking surface of roller 38 is continually coated with ink from a rotating sponge inking roller 36. The inking roller is soaked with ink and located so that its outer cylindrical surface is in touching relation with the outer surface of roller 38 to transfer ink to the transfer roller 38. The reinked ribbon 14 is then guided between the ribbon drive roller 31 having rows of longitudinal V-shaped grooves on its outer surface, and a cooperating opposing driven roller 33. This roller 31 is driven by a motor of controlled speed, such as a ribbon stepping motor (not shown), of the printer. The motor has a rotating shaft that engages an internal central bore of the drive roller 31 causing the roller to move in concert with the shaft. The motor's shaft engages the roller's bore when the ribbon cassette is installed in the printer. The opposing driven pulley 33 is equipped with V-shaped teeth on its outer surface that cooperate with the grooves of the drive roller. Driven roller 33 is rotatably mounted on a spring loaded platform 35 that is urged toward tape drive roller 31 so that ribbon 14 is tightly engaged between the two rollers and is drawn into the stuffing box 12 as the driven pulley rotates. The inked ribbon accumulates in the stuffing box and ultimately exits through outlet ribbon guide 16 after being twisted through 180°. Due to this twisting, the entire endless ribbon forms a Möebius loop so that both sides of the tape are ultimately inked, and each side is successively used to transfer ink onto paper.

As explained above, during printing ribbon use, the printheads of the print hammers transfer ink from the ribbon to paper. Since the ribbon is constantly fed past the print hammers at a preset speed, at some point, residual ink on the ribbon will be insufficient to allow the printing of visually clear characters. As a result, print characters will progressively fade. In an attempt to reduce this phenomenon, and to prolong the life of printer ribbons, the ribbon is continuously reinked using the inking roller, as explained above. Typically, however, this reinking is carried out with the ribbon traveling at a constant rate so that when the ribbon cartridge is relatively new, and particularly if the number of characters printed per line is relatively low, too much ink is transferred onto the ribbon. This excess ink migrates onto the print hammer bank, causing fouling of the hammers. On the other hand, despite reinking of the ribbon, visual print clarity gradually fades as the ribbon ages in continuous use due to ink sponge exhaustion. The reinking mechanism extends the useful life of the ribbon by slowing down the print fading process as compared to ribbons without reinking systems.

In the selection of a printer, purchase cost and running costs are considerations. While it is desirable to extend printer ribbon useful life, this goal must be met at low cost by using a simple and reliable mechanism. There yet exists a need for a system for extending useful ribbon life while maintaining visual clarity of printed characters. The system should not cause failure of the printer mechanism due to overinking, but should nevertheless supply sufficient ink to the ribbon so that visual print clarity is maintained even when the number of dots or characters is relatively high. Furthermore, the system should be simple, reliable, and of low cost.

SUMMARY OF THE INVENTION

The invention provides a system for extending printing ribbon useful life by controlling the reinking of a printer ribbon to prevent both overinking and underinking. Thus, by preventing overinking, the system effectively reduces the risk of fouling of the printer mechanism due to excess ink. At the same time, by avoiding underinking, the system prolongs the life of a ribbon, particularly one subject to high print density, by significantly ameliorating the visual fading of printed characters that takes place as a ribbon ages in service.

In accordance with the system of the invention, a counter is initiated when a new or replacement ribbon is placed in operation in a printer. This counter accumulates the number of characters printed and print density (the percentage of the total number of columns available that is actually printed). Based on the accumulated number of characters printed and print density, the system controls the inking rate of the ribbon by controlling ribbon speed which in turn controls the rate of ink supply from the reinking sponge.

At preset time intervals, the system compares the actual accumulated number of characters printed with a preset control number of characters. The system also compares the actual print density with a preset control print density. When the total number of characters printed and the actual print density exceed the preset control limits, the printer ribbon speed is increased to allow a greater length of the ribbon to be reinked per unit of time. The increased ribbon speed reduces the rate of ink usage per length of ribbon while the quality of reinking applied per length remains approximately constant. The net effect is that more ink is added to the ribbon per dot printed. This maintains print character visual clarity. Conversely, if the accumulated number of characters printed and the actual print density are less than preset control limits, then ribbon speed is decreased to decrease ribbon reinking rate to avoid fouling of printing hammers with excess ink. Thus, the system is able to adjust to variations in the intensity of printer use as the printing process continues.

The invention also provides a printer with a printhead that has a plurality of print hammers adapted for striking an inked ribbon and transferring ink from the ribbon to paper fed controlledly through the printer. The printer is characterized in that it has an electronic counter for counting and accumulating the number of characters printed with the reinkable ribbon and the print density over a preset period of time. The printer also includes a logic system, in electrical communication with the electronic counter. The logic system performs the functions of comparing the number of characters printed with a preset limit, and comparing the actual print density with another preset limit. The system then generates a control signal, based upon the differences, that controls an adjustable speed ink ribbon drive motor, in electrical communication with the logic system, and that adjusts the speed of ribbon travel. Thus, in accordance with the invention, the printer adjusts the rate of application of ink to the printing ribbon depending upon the accumulated number of characters printed and the print density so that visual print clarity is maintained.

The invention provides a system that is simple, inexpensive, and readily integrated into ribbon impact printers, that prolongs the useful life of the printing ribbon while avoiding problems associated with ribbon overinking. The invention also provides a printer incorporating this system. Additionally, the system may be retrofitted to existing printers by replacing the control logic of the printer with the logic system of the invention.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The invention provides a system for extending the useful life of a printer ribbon while maintaining the visual density of print characters produced from a reinkable printer ribbon by adjusting the reinking of the ribbon in proportion to the ink used. In the preferred embodiment, as applied to a printing ribbon housed in a cassette with reinking means, the reinking rate is controlled by adjusting the speed of travel of the ribbon and hence the amount of ink that is transferred from the reinking means per unit of time. The transfer of ink from the preferred reinking means, a reinking sponge transfer roller, to the ribbon surface remains substantially constant and invariant with ribbon speed, i.e., the same amount of ink is transferred from the reinking roller to the ribbon for each revolution of the roller. However, ribbon "inking ratio" is controlled. This ratio is defined as the ratio of ink applied to the ribbon per unit time, to the ink removed from the ribbon per unit of time. When ribbon speed increases, the amount of ink used per length of ribbon due to printing decreases while ink applied to the ribbon per length is fairly constant. The net effect of increasing ribbon speed is to maintain a greater quantity of ink on the ribbon to provide greater visual clarity of printed characters. Conversely, when ribbon speed is decreased, the ratio of ink used to ink applied is increased. Although the ink transferred to a length of ribbon is fairly constant with each revolution of the transfer roll leading to a constant transfer rate regardless of speed, the amount, or rate of transfer, of ink will decrease as the sponge is depleted of ink.

In accordance with the invention, there is provided both a system, and a printer utilizing the system, for controlling the inking ratio of a reinkable printing ribbon, typically used in a dot matrix printer. Both the printer and the system include an electronic counter for counting the number of characters printed with the reinkable ribbon and the print density over a preset period of time. "Print density" is defined as the number of columns printed divided by the total number of columns printable. Thus, for example, when only 33 columns are actually printed and 132 columns are printable, then the print density is 33÷132=25.0%. The logic system is in electrical communication with the electronic counter and performs several functions. These functions include comparing the number of characters printed with a preset limit, comparing actual print density with a preset limit, and generating a control signal depending upon the differences. The control signal is used to control the speed of an adjustable speed ink ribbon drive motor, typically in electrical communication with the logic system.

Figure 1:
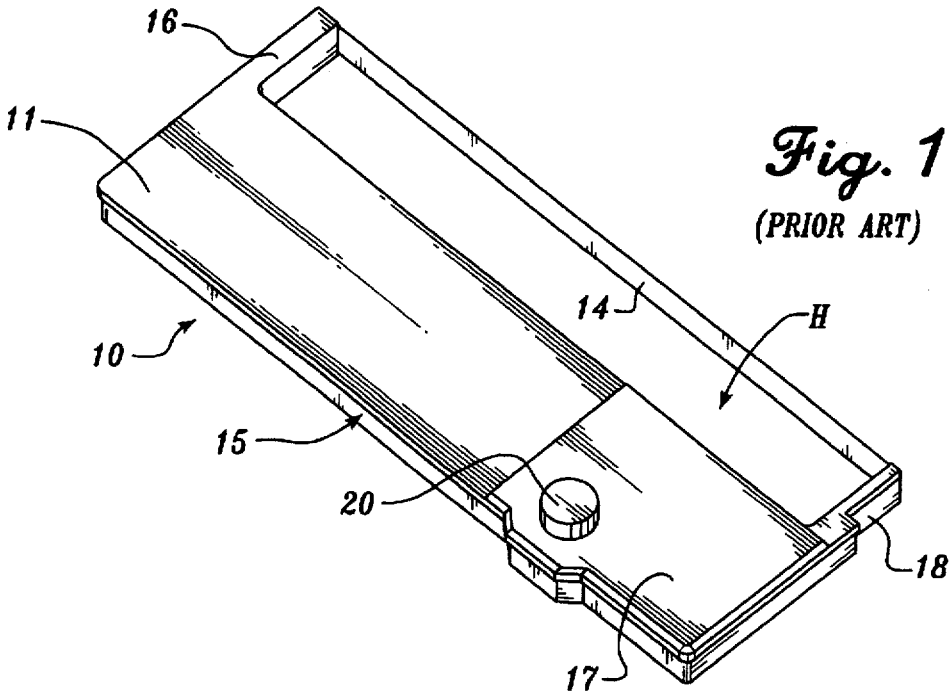
Fig. 1. (PRIOR ART)
FIG. 1 is an example of a prior art ribbon printer cassette.
Figure 2:
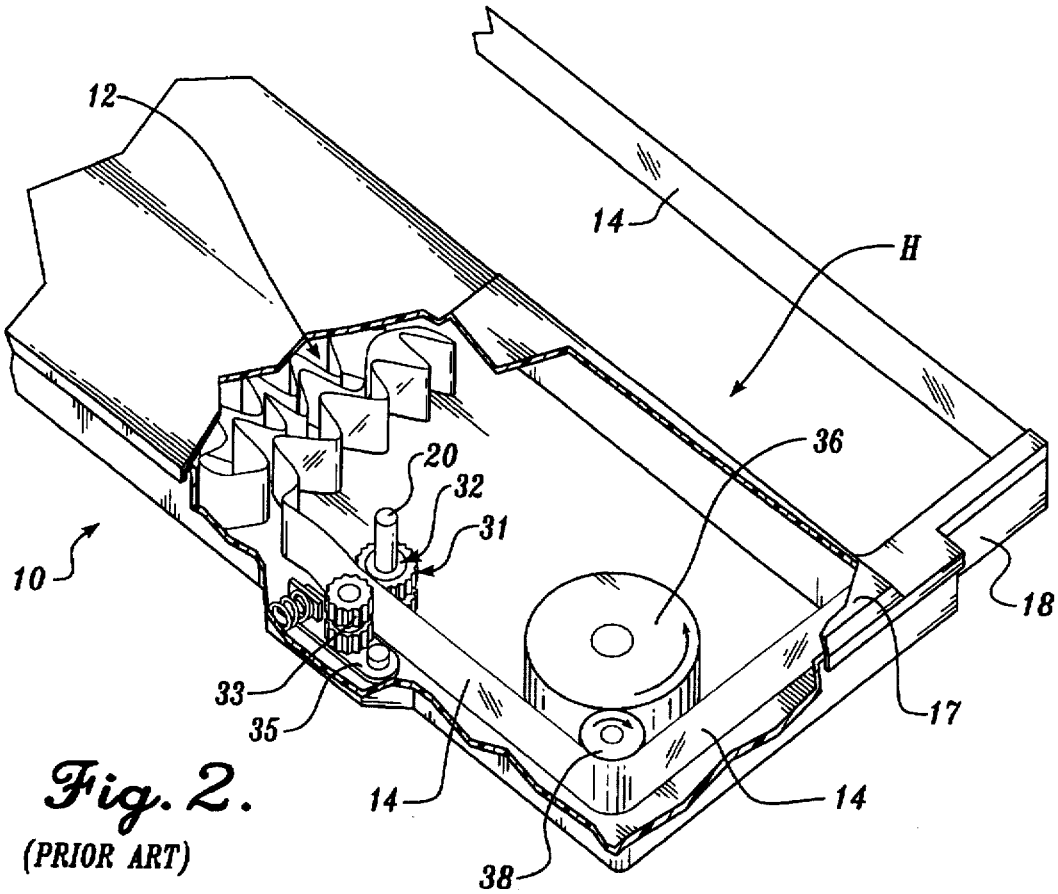
Fig. 2. (PRIOR ART)
FIG. 2 is a partial cross-sectional view of the cassette of FIG. 1.
Figure 3:
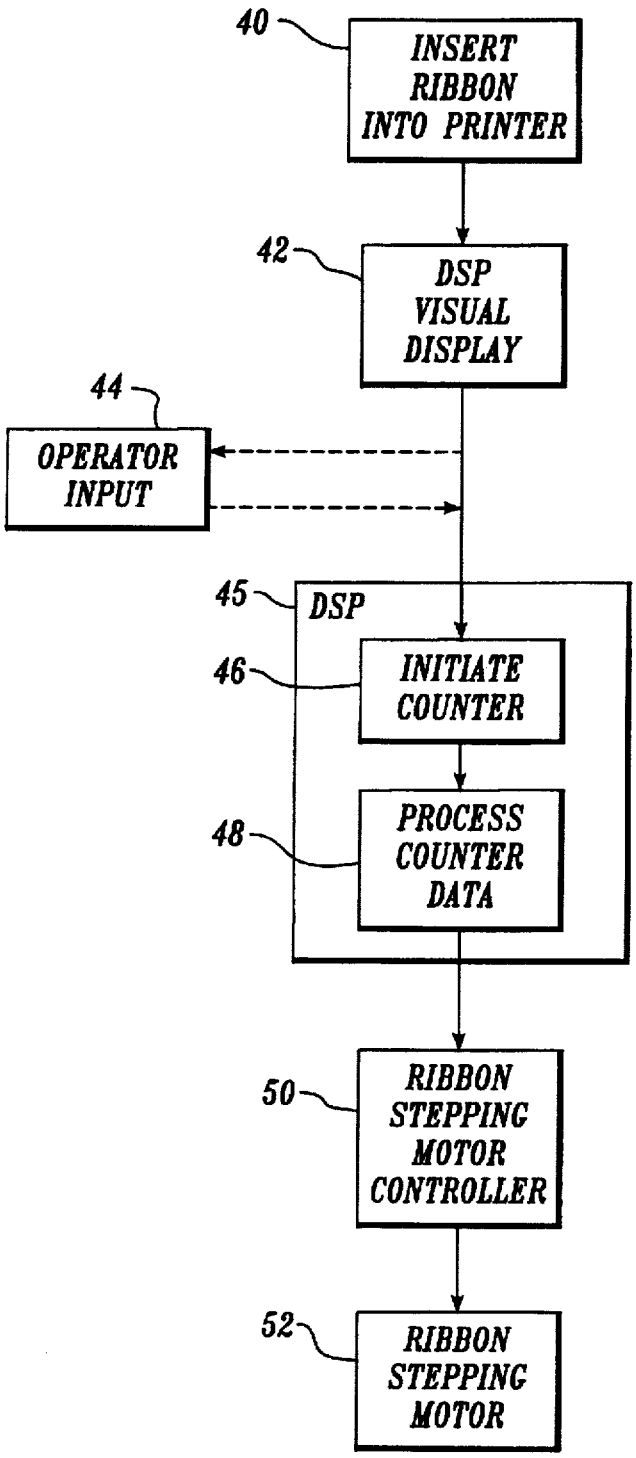
FIG. 3 is a schematic representation of an embodiment of the system of the invention.

FIG. 3 is a schematic representation of a preferred embodiment of the system of the invention, commencing with the insertion 40 of a new or replacement ribbon into a printer, and terminating with the adjustment of the ribbon speed in the printer. A new or replacement ribbon, such as a cassette printer ribbon, is placed into the appropriate slot in a printer. In the case of a cassette ribbon, conventionally a platen in the printer has to be raised to an open position so that the cassette may be inserted. Thereafter, the platen is moved downward, to a closed position, so that the exposed ribbon of the cassette is interposed between print hammers and paper.

In certain printers, such as the commercially available Mannesmann Tally printers, the opening of the platen results in a visual display 42, typically a liquid crystal display, indicating that the platen is open. This visual display, according to the invention, may be modified, by appropriate programming of a digital signal processor associated with the printer, to inquire whether a new or replacement cassette has been inserted, as indicated in Block 42. (Of course, with an appropriate sensor, in accordance with the invention, the printer itself could determine if a new ribbon has been installed without operator intervention.) In response to this query, operator input in Block 44, by pressing an appropriate button on a keypad provided with these printers, will confirm the insertion of a new ribbon cassette. Alternatively, the visual display may indicate that a replacement cassette has been inserted, and automatically initiate the counter of Block 46. The counter, typically integrated with the digital signal processor 45, counts the number of characters printed by the print hammers, and the print density for a preset time interval. As explained more fully below, this preset time interval may be fixed, or may be varied by operator input. The counted number of characters is processed in a control system, in Block 48, of the digital signal processor. This control system is explained more fully below. The digital signal processor 45 generates a control signal, dependent upon the output of the control system, communicated electrically to a ribbon drive motor controller, such as a stepping motor controller 50. This ribbon stepping motor controller, in turn, generates another control signal that controls the speed of the ribbon stepping motor 52, thereby controlling the speed of the ribbon. Since both the reinking and ink usage from the ribbon are dependent upon ribbon speed, the above-described system effectively controls the "inking ratio," i.e., the ratio of ink applied to ink removed. As the ribbon ages, or as print density, defined as the number of columns printed divided by the total number of columns, increases, the ratio increases. Conversely, for a fairly new ribbon, operating under low print density conditions, the ratio may be decreased.

Figure 4:
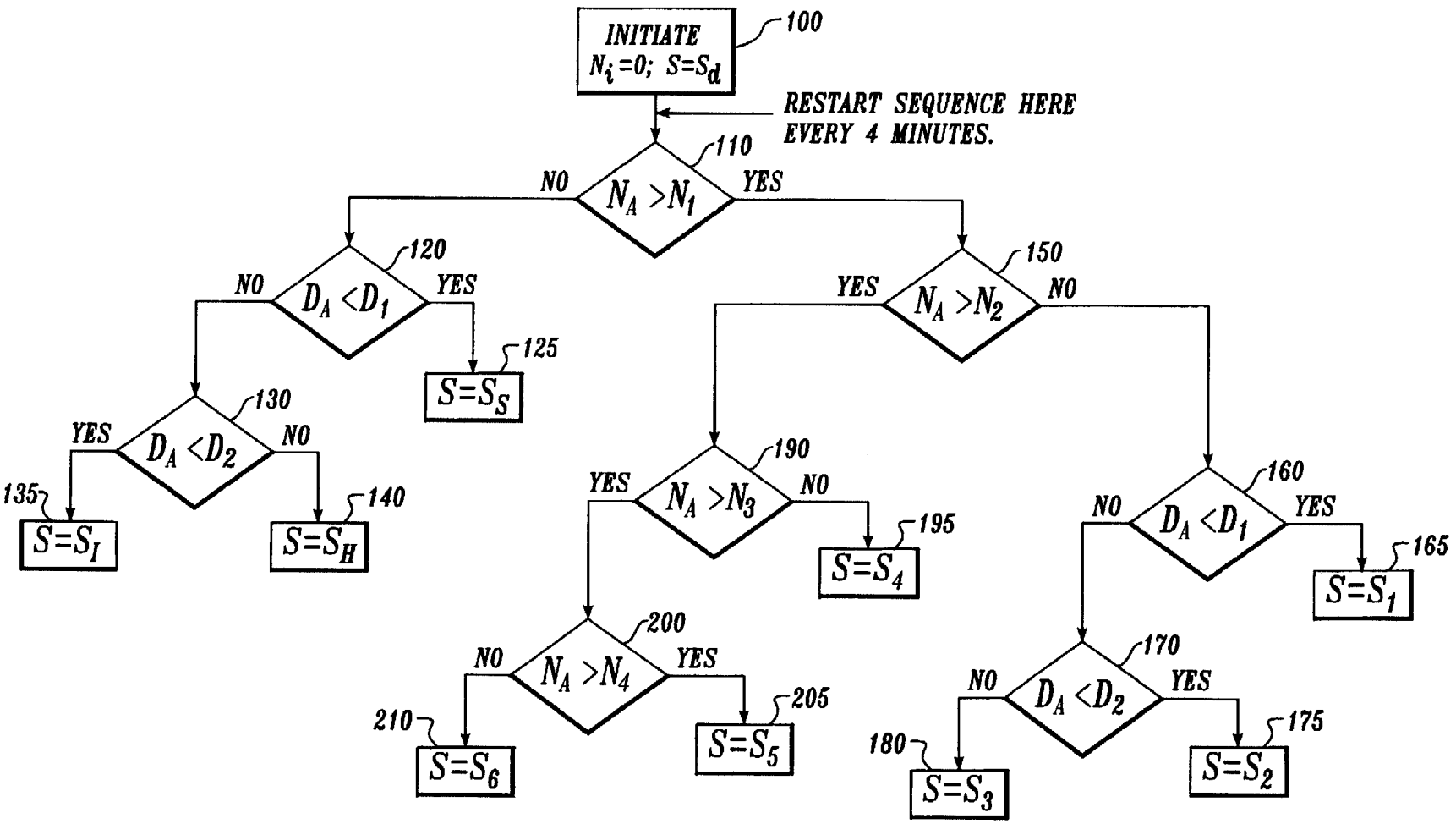
FIG. 4 is a diagram showing some of the steps performed in an embodiment of a system according to the invention.

The control system of the invention may more easily be understood with reference to FIG. 4, a flow diagram showing steps of the control system. As a preliminary matter, as discussed above, the system is initiated when a cassette is inserted into a printer and an electrical signal is sent to a digital signal processor associated with the printer that performs the steps of the control logic. Upon cassette ribbon insertion, the printer platen will be opened and then closed. Either the opening or closing of the platen may be used to initiate the sequence set forth in FIG. 4, at block 100, along with operator input as explained above. Initiation sets the character counter to zero and the ribbon speed to a default value.

After initiation, the printer operates and the electronic character counter counts the number of characters printed for a predetermined time, typically ranging from about 2 minutes to about 5 minutes. This limit may be selected depending upon the print density variations expected for the printer, or may be a fixed interval. Also, note that a cassette ribbon printer stuffing box may contain about 50–60 meters of ribbon so that a fast response time is not required.

At the end of a preset time period, the counted number of characters $N_A$ printed is compared with a predetermined number of characters $N_1$ in block 110. For example, this predetermined number could be 3,000,000. If the number of characters printed $N_A$ is less than 3,000,000, then the actual print density $D_A$ is compared in block 120 with a predetermined print density $D_1$, for example 30%. If the print density $D_A$ is less than this predetermined value $D_1$, then the ribbon speed is set to a low speed $S_S$ in block 125, for example 330 inches per minute, to avoid overinking the ribbon. This ribbon speed adjustment is achieved by controlling the speed of the stepping motor that rotates the ribbon drive pulley of the cassette ribbon. On the other hand, if the print density $D_A$ exceeds the predetermined value $D_1$, then block 130 determines whether the print density is less than a second predetermined print density $D_2$ (greater than $D_1$), for example 60%. If the print density $D_A$ is greater than the second predetermined value $D_2$, then the ribbon speed is set to a higher speed $S_H$ in block 140, for example 500 inches per minute, to avoid visual fading of printed characters. On the other hand, if the ribbon speed is greater than the first predetermined value, but less than the second predetermined value, then the ribbon speed is set to an intermediate speed $S_I$ in block 135, for example 420 inches per minute.

The above-described portion of the system is designed to prevent applying too much ink to the ribbon, usually when the ribbon is fairly new, a condition that can result in fouling of print hammers. In another aspect of the system, also shown in FIG. 4, the system extends the life of the ribbon, while maintaining the visual density of printed characters.

When the number of printed characters counted exceeds the first predetermined level $N_1$, as determined in block 110, then block 150 compares the number of counted characters to see whether it exceeds a second predetermined number of counts $N_2$, where $N_2$ is greater than $N_1$. For example, $N_2$=6,000,000. If the actual number of characters $N_A$ is less than the second predetermined number of characters $N_2$, then block 160 checks print density. If the actual print density $D_A$ is less than a first predetermined amount $D_1$, say 30%, then the ribbon speed is adjusted to a first speed $S_1$ in block 165, for example 420 inches per minute. On the other hand, if actual print density $D_A$ exceeds the first predetermined density level $D_1$, then block 170 determines whether the print density $D_A$ exceeds a second predetermined print density level $D_2$, for example 60%. If the print density $D_A$ does not exceed the second predetermined level $D_2$, then the ribbon speed is adjusted to a certain speed $S_2$, for example 450 inches per minute, in block 175. On the other hand, if print density $D_2$ exceeds the second predetermined print density $D_2$, then the ribbon speed is set in block 180 to a different, faster speed $S_3$, for example 500 inches per minute, to prevent optical fading of printed characters.

Returning now to block 150, if the number of characters counted exceeds the second predetermined number of characters $N_2$, then block 190 compares the number of characters counted with a third predetermined number of characters $N_3$, $N_3$ being greater than $N_2$. For example, $N_3$=8,000,000. If this third predetermined number of characters $N_3$ is not exceeded, i.e. the actual number of characters printed $N_A$ is intermediate between the second $N_2$ and third predetermined number of characters $N_3$, then block 195 sets the ribbon speed to a higher speed $S_4$, for example 555 inches per minute. On the other hand, if the actual number of characters printed $N_A$ exceeds even the third predetermined number of characters $N_3$, then block 200 yet again compares the actual number of characters printed $N_A$ with a fourth predetermined amount of characters $N_4$, where $N_4$ is greater than $N_3$, for example, $N_4$=10,000,000. If the number of characters printed exceeds this fourth predetermined number of characters $N_4$, then the ribbon speed is set in block 205 at $S_5$, a high speed, for example, 730 inches/minute. On the other hand, if the actual number of characters printed is less than the fourth predetermined number of characters $N_4$, then another ribbon speed is set in block 210 at $S_6$, less than $S_5$, for example, $S_6$ is about 625 inches/minute.

Use of the above-described control system extends the useful life of reinkable printing ribbons by varying ribbon speed to allow a variable inking ratio of the ribbon thereby maintaining visual print density. However, once visual print density declines to below acceptable levels, even when using the system of the invention, the cassette ribbon must be replaced. It is, however, estimated that the system of the invention has the potential of increasing the life of a reinkable printing ribbon by from about 10 to about 20% for a conventional cassette-housed ribbon fabricated from a woven nylon fabric. The printer of the invention incorporates all the advantages of the logic control system permitting a longer useful life of a printer ribbon while reducing the tendency of the printer to produce printed characters of progressively fading visual clarity.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of controlling the amount of ink applied to a ribbon that is reinked at a rate related to the rate of movement of the ribbon through a printer, the method comprising:

(a) counting the number of characters printed using the reinkable ribbon;

(b) maintaining a total count of the number of characters printed using the reinkable ribbon;

(c) periodically comparing the total count of the number of characters printed using the reinkable ribbon with a first number of characters limit;

(d) calculating a print density by dividing the number of characters printed during a predetermined period by the total number of character positions available for printing during the predetermined period;

(e) comparing the calculated print density with a first print density limit; and (f) controlling the amount of ink applied to the ribbon by setting the speed of the ribbon to a value that is based on the result of periodically comparing the total count of the number of characters printed using the reinkable ribbon with the first number of characters limit and the result of comparing the calculated print density with the first print density limit.

2. The method of claim 1, wherein the ribbon is contained in a ribbon cassette.

3. The method of claim 1, wherein setting the speed of the ribbon comprises adjusting the speed of a ribbon stepping motor.

4. The method of claim 1, wherein if the total count of the number of characters printed using the reinkable ribbon is less than the first number of characters limit and if the calculated print density is less than the first print density limit, the speed of the ribbon is set to a first value.

5. The method of claim 4, wherein:

(a) if the total count of the number of characters printed using the reinkable ribbon is less than the first number of characters limit and if the calculated print density is greater than the first print density limit, comparing the calculated print density with a second print density limit;

(b) if the calculated print density is less than the second print density limit, the speed of the ribbon is set to a second value that is greater than said first value; and (c) if the calculated print density is greater than the second print density limit, the speed of the ribbon is set to a third value that is greater than said second value.

6. The method of claim 5, wherein if the total count of the number of characters printed using the reinkable ribbon is greater than the first number of characters limit, comparing the total count of the number of characters printed with a second number of characters limit prior to comparing the calculated print density with the first print density limit.

7. The method of claim 6, wherein if the total count of the number of characters printed using the reinkable ribbon is less than the second number of characters limit and if the calculated print density is less than the first print density limit, the speed of the ribbon is set to a fourth value.

8. The method of claim 7; wherein:

(a) if the total count of the number of characters printed using the reinkable ribbon is less than the second number of characters limit and if the calculated print density is greater than the first print density limit, comparing the calculated print density with the second print density limit;

(b) if the calculated print density is less than the second print density limit, the speed of the ribbon is set to a fifth value that is greater than said fourth value; and (c) if the calculated print density is greater than the second print density limit, the speed of the ribbon is set to a sixth value that is greater than said fifth value.

9. The method of claim 8, wherein:

(a) if the total count of the number of characters printed using the reinkable ribbon is greater than the second number of characters limit, comparing the total count of the number of characters printed using the reinkable ribbon with a third number of characters limit;

(b) if the total count of the number of characters printed using the reinkable ribbon is less than the third number of characters limit, the speed of the ribbon is set to a seventh value that is greater than said sixth value;

(c) if the total count of the number of characters printed using the reinkable ribbon is greater than the third number of characters limit, comparing the total count of the number of characters printed using the reinkable ribbon with a fourth number of characters limit;

(d) if the total count of the number of characters printed using the reinkable ribbon is less than the fourth number of characters limit, the speed of the ribbon is set to an eighth value that is greater than said seventh value; and (e) if the total count of the number of characters printed using the reinkable ribbon is greater than the fourth number of characters limit, the speed of the ribbon is set to a ninth value that is greater than said eighth value.

10. The method of claim 1, wherein if the total count of the number of characters printed using the reinkable ribbon is greater than the first number of characters limit, comparing the total count of the number of characters printed with a second number of characters limit prior to comparing the calculated print density with the first print density limit.

11. The method of claim 10, wherein if the total count of the number of characters printed using the reinkable ribbon is less than the second number of characters limit and if the calculated print density is less than the first print density limit, the speed of the ribbon is set to a first value.

12. The method of claim 11, wherein:

(a) if the total count of the number of characters printed using the reinkable ribbon is less than the second number of characters limit and if the calculated print density is greater than the first print density limit, comparing the calculated print density with a second print density limit;

(b) if the calculated print density is less than the second print density limit, the speed of the ribbon is set to a second value that is greater than said first value; and (c) if the calculated print density is greater than the second print density limit, the speed of the ribbon is set to a third value that is greater than said second value.

13. The method of claim 12, wherein:

(a) if the total count of the number of characters printed using the reinkable ribbon is greater than the second number of characters limit, comparing the total count of the number of characters printed using the reinkable ribbon with a third number of characters limit;

(b) if the total count of the number of characters printed using the reinkable ribbon is less than the third number of characters limit, the speed of the ribbon is set to a fourth value that is greater than said third value;

(c) if the total count of the number of characters printed using the reinkable ribbon is greater than the third number of characters limit, comparing the total count of the number of characters printed using the reinkable ribbon with a fourth number of characters limit;

(d) if the total count of the number of characters printed using the reinkable ribbon is less than the fourth number of characters limit, the speed of the ribbon is set to a fifth value that is greater than said fourth value; and (e) if the total count of the number of characters printed using the reinkable ribbon is greater than the fourth number of characters limit, the speed of the ribbon is set to a sixth value that is greater than said fifth value.

14. The method of claim 10, wherein:

(a) if the total count of the number of characters printed using the reinkable ribbon is greater than the second number of characters limit, comparing the total count of the number of characters printed using the reinkable ribbon with a third number of characters limit;

(b) if the total count of the number of characters printed using the reinkable ribbon is less than the third number of characters limit, the speed of the ribbon is set to a first value;

(c) if the total count of the number of characters printed using the reinkable ribbon is greater than the third number of characters limit, comparing the total count of the number of characters printed using the reinkable ribbon with a fourth number of characters limit;

(d) if the total count of the number of characters printed using the reinkable ribbon is less than the fourth number of characters limit, the speed of the ribbon is set to a second value that is greater than said first value; and (e) if the total count of the number of characters printed using the reinkable ribbon is greater than the fourth number of characters limit, the speed of the ribbon is set to a third value that is greater than said second value.

15. In a printer that prints characters on a print receiving medium by causing print hammers to impact print elements, said impact causing said print elements to strike a ribbon and transfer ink from said ribbon to said print receiving medium, said print ribbon being inked as said print ribbon moves through said printer at a rate related to the speed of movement of said print ribbon, the improvement comprising a system for controlling the amount of ink applied to said print ribbon, said system comprising:

(a) a speed-controllable drive for moving said ribbon as said printer prints characters; and (b) a ribbon speed control subsystem coupled to said speed-controllable drive for controlling the rate at which said speed-controllable drive moves said ribbon through said printer as said printer prints characters, said ribbon speed control subsystem including a signal processor for:

(1) receiving and storing information about the total number of characters printed by said ribbon;

(2) periodically comparing the total number of characters printed by said ribbon with a first number of characters limit;

(3) calculating a print density by dividing the number of characters printed during a predetermined period by the total number of character positions available for printing during the predetermined period;

(4) comparing the calculated print density with a first print density limit; and (5) supplying a speed control signal to said speed-controllable drive mechanism whose value is based on the result of comparing the total number of characters printed with the first number of characters limit and the result of comparing the calculated print density with the first print density limit.

16. The improvement claimed in claim 15, wherein if the total number of characters printed by said ribbon is less than the first number of characters limit and if the calculated print density is less than the first print density limit, the speed control signal has a first value.

17. The improvement claimed in claim 16, wherein:

(a) if the total number of characters printed by said ribbon is less than the first number of characters limit and if the calculated print density is greater than the first print density limit, the signal processor compares the calculated print density with a second print density limit:

(b) if the calculated print density is less than the second print density limit, the speed control signal has a second value that is greater than said first value; and (c) if the calculated print density is greater than the second print density limit, the speed control signal has a third value that is greater than said second value.

18. The improvement claimed in claim 17, wherein if the total number of characters printed by said ribbon is greater than the first number of characters limit, the signal processor compares the total number of characters printed with a second number of characters limit prior to comparing the calculated print density with the first print density limit.

19. The improvement claimed in claim 18, wherein if the total number of characters printed by said ribbon is less than the second number of characters limit and if the calculated print density is less than the first print density limit, the speed of control signal has a fourth value.

20. The improvement claimed in claim 19, wherein:

(a) if the total number of characters printed by said ribbon is less than the second number of characters limit and if the calculated print density is greater than the first print density limit, the signal processor compares the calculated print density with a second print density limit;

(b) if the calculated print density is less than the second print density limit, the speed control signal has a filth value that is greater than said fourth value; and (c) if the calculated print density is greater than the second print density limit, the speed control signal has a sixth value that is greater than said fifth value.

21. The improvement claimed in claim 20, wherein:

(a) if the total number of characters printed by said ribbon is greater than the second number of characters limit, the signal processor compares the total number of characters printed by said ribbon with a third number of characters limit;

(b) if the total number of characters printed by said ribbon is less than the third number of characters limit, the speed control signal has a seventh value that is greater than said sixth value;

(c) if the total number of characters printed by said ribbon is greater than the third number of characters limit, the signal processor compares the total number of characters printed by said ribbon with a fourth number of characters limit;

(d) if the total number of characters printed by said ribbon is less than the fourth number of characters limit, the speed control signal has an eighth value; and (e) if the total number of characters printed by said ribbon is greater than the fourth number of characters limit, the speed control signal has a ninth value that is greater than said eighth value.

22. The improvement claimed in claim 21, wherein if the total number of characters printed by said ribbon is greater than the first number of characters limit, the signal processor compares the total number of characters printed by said ribbon with a second number of characters limit prior to comparing the calculated print density with the first print density limit.

23. The improvement claimed in claim 22, wherein if the total number of characters printed by said print ribbon is less than the second number of characters limit and if the calculated print density is less than the first print density limit, the speed control signal has a first value.

24. The improvement claimed in claim 23, wherein:

(a) if the total number of characters printed by said ribbon is less than the second number of characters limit and if the calculated print density is greater than the first print density limit, the signal processor compares the calculated print density with a second print density limit;

(b) if the calculated print density is less than the second print density limit, the speed control signal has a second value that is greater than said first value; and (c) if the calculated print density is greater than the second print density limit, the speed control signal has a third value that is greater than said second value.

25. The improvement claimed in claim 24, wherein:

(a) if the total number of characters printed by said reinkable ribbon is greater than the second number of characters limit, the signal processor compares the total number of characters printed by said ribbon with a third number of characters limit;

(b) if the total number of characters printed by said ribbon is less than the third number of characters limit, the speed control signal has a fourth value that is greater than said third value;

(c) if the total number of characters printed by said ribbon is greater than the third number of characters limit, the signal processor compares the total number of characters printed by said ribbon with a fourth number of characters limit;

(d) if the total number of characters printed by said ribbon is less than the fourth number of characters limit, the speed control signal has a fifth value that is greater than said fourth value; and (e) if the total number of characters printed by said ribbon is greater than the fourth number of characters limit, the speed control signal has a sixth value that is greater than said fifth value.

26. The improvement claimed in claim 22, wherein:

(a) if the total number of characters printed by said ribbon is greater than the second number of characters limit, the signal processor compares the total number of characters printed by said ribbon with a third number of characters limit;

(b) if the total number of characters printed by said ribbon is less than the third number of characters limit, the speed control signal has a first value;

(c) if the total number of characters printed by said ribbon is greater than the third number of characters limit, the signal processor compares the total number of characters printed by said ribbon with a fourth number of characters limit;

(d) if the total number of characters printed by said ribbon is less than the fourth number of characters limit, the speed control signal has a second value that is greater than said first value; and (e) if the total number of characters printed by said ribbon is greater than the fourth number of characters limit, the speed control signal has a third value that is greater than said second value.

* * * * *

UNITED STATES PATENT AND TRADEMARK OFFICE

CERTIFICATE OF CORRECTION

PATENT NO. : 5,685,653
DATED : November 11, 1997
INVENTOR(S) : E.D. Bringhurst

It is certified that error appears in the above-identified patent and that said Letters Patent is hereby corrected as shown below:

| COLUMN | LINE | |
|---|---|---|
| 10 (Claim 20, | 59 line 9) | "filth" should read --fifth-- |

Signed and Sealed this

Nineteenth Day of May, 1998

Bruce Lehman

*Attest:*

BRUCE LEHMAN

*Attesting Officer*

*Commissioner of Patents and Trademarks*